US005311262A

United States Patent [19]

Shimizu et al.

[11] Patent Number: 5,311,262

[45] Date of Patent: May 10, 1994

[54] DEVELOPING DEVICE FOR USE IN AN IMAGE FORMING APPARATUS

[75] Inventors: Tamotsu Shimizu, Settsu; Hiroshi Murasaki, Ibaragi; Masahiko Matsuura, Amagasaki; Susumu Mikawa, Itami, all of Japan

[73] Assignee: Minolta Camera Kabushiki Kaisha, Osaka, Japan

[21] Appl. No.: 772,942

[22] Filed: Oct. 8, 1991

[30] Foreign Application Priority Data

Oct. 9, 1990 [JP] Japan ..... 2-271605
Aug. 29, 1991 [JP] Japan ..... 3-218423

[51] Int. Cl.[5] ..... G03G 15/00
[52] U.S. Cl. ..... 355/251; 118/658
[58] Field of Search ..... 355/245, 251, 253; 118/653, 658, 656

[56] References Cited

U.S. PATENT DOCUMENTS

| | | | |
|---|---|---|---|
| 3,939,801 | 2/1976 | Tanaka et al. | 118/637 |
| 3,952,701 | 4/1976 | Yamashita et al. | 118/658 |
| 4,030,447 | 6/1977 | Takahashi et al. | 118/658 |
| 4,177,757 | 12/1979 | Murakawa et al. | 118/658 |
| 4,331,100 | 5/1982 | Mochizuki | 118/658 X |
| 4,354,454 | 10/1982 | Nishikawa | 118/658 |
| 4,498,755 | 2/1985 | Ohkubo et al. | 355/253 |
| 4,679,527 | 7/1987 | Chang | 118/658 |
| 4,887,131 | 12/1989 | Kinoshita et al. | 355/253 |
| 4,947,200 | 8/1990 | Kumasaka et al. | 355/251 |

FOREIGN PATENT DOCUMENTS

| | | | |
|---|---|---|---|
| 46350 | 3/1983 | Japan . | |
| 46351 | 3/1983 | Japan . | |
| 121053 | 7/1983 | Japan . | |
| 0168177 | 8/1985 | Japan | 355/251 |
| 14665 | 2/1991 | Japan . | |

*Primary Examiner*—A. T. Grimley
*Assistant Examiner*—Robert Beatty
*Attorney, Agent, or Firm*—Burns, Doane, Swecker & Mathis

[57] ABSTRACT

In an image forming apparatus accommodating a developing device, a developing roller 1 includes a magnet member 3 non-rotatably fixed and a sleeve 2 rotatably moved around the outer surface of the magnet member 3, powdery developers D held on the outer periphery of the sleeve 2 are brought into contact with a photosensitive member 10 to visualize an electrostatic latent image, and the magnet member 3 is provided with a magnetic pole portion $N_0$ having first and second magnetic poles $N_1$ and $N_2$. The first and second magnetic poles $N_1$ and $N_2$ have the same polarities and are adjacent to each other and confront the photosensitive member 10. The powdery developers D include three developer parts, an upper developer $D_1$, a middle developer $D_{12}$ and a lower developer $D_2$, which are successively retained on the outer surface of the sleeve 2 by the first and second magnetic poles $N_1$ and $N_2$. The upper developer $D_1$ retained by the first magnetic pole $N_1$ and the middle developer $D_{12}$ retained by the middle portion between the first and second magnetic poles $N_1$ and $N_2$ are brought into contact with the photosensitive member, while the lower developer $D_2$ retained by the second magnetic pole $N_2$ is held out of contact with the photosensitive member.

18 Claims, 14 Drawing Sheets

DEVELOPING DEVICE FOR USE IN AN IMAGE FORMING APPARATUS

BACKGROUND OF THE INVENTION

1. Field of the Invention

The present invention relates to a developing device for developing an electrostatic latent image to be visualized by contacting powdery developer (or developing powder) onto a photosensitive member, and in particular to an image forming apparatus such as a copying machine, printer or the like accommodating such a developing device.

2. Description of Related Art

Conventionally, there have been proposed some kinds of developing devices each including a developing roller constituted by a magnet column member with a plurality of magnetic poles and a sleeve overlaid on the outer surface of the magnet column member wherein an electrostatic latent image is turned visual by contacting developing powder retained on the outer surface of the sleeve with the outer surface of a photosensitive member. These developing devices are classified broadly into two types, an inner pole fixed type and an inner pole rotary type. In each of the inner pole fixed type developing devices 101*a* and 101*b* as shown in FIGS. 1 and 2 respectively, a magnet column member 103 is non-rotatably fixed and a cylindrical sleeve member 102 overlaid on the outer surface of the magnet column member 103 is rotated in a direction shown by an arrow a. On the other hand, in the inner pole rotary type developing device 101*c* as shown in FIG. 3, the magnet column member 103 as well as the sleeve member 102 overlaid thereon is rotated in a direction shown by an arrow a'.

Moreover, the inner pole fixed typed developing devices are generally classified into two types, a single pole type as shown in FIG. 1 and a double pole type as shown in FIG. 2. In the single pole typed developing device 101*a*, as shown in FIG. 1, there is provided a single magnetic pole N confronting to a developing zone Q between the sleeve 102 and the photosensitive member 100 closely facing to each other, and only the developing powder retained by the magnetic pole N is brought into contact with the outer surface of the photosensitive member 100 so as to form a toner image. In the double pole typed developing device 101*b*, as shown in FIG. 2, there are provided double pairs of magnetic poles ($N_1$, $S_1$) and ($N_2$, $S_2$) in the outer peripheral portions of the magnet column member 103, wherein the magnetic poles $N_1$ and $N_2$ ($S_1$ and $S_2$) have the same polarities and the magnetic poles $N_1$ and $N_2$ are adjacent to each other in the outer peripheral portion of the magnet column member 103 confronting to the developing zone Q, so that the developing powder portions retained by the magnetic poles $N_1$ and $N_2$ are both contacted onto the outer surface of the photosensitive member 100 so as to develop an electrostatic latent image to be visible. It is to be noted here that the transporting speed of the developers in these developing devices of three kinds is set faster than the moving speed of the surface of the photosensitive member.

However, these developing devices 101*a*, 101*b* and 101*c* have various drawbacks respectively as following.

(a) A SINGLE POLE TYPED DEVELOPING DEVICE 101*a*

Some problems encountered in use of the single pole typed developing device 101*a* will be described below. A first problem is that, since the developing powder 106 retained by the magnetic pole N closely facing to the outer surface of the photosensitive member 100 is in high density at a separating portion just when the developing powder is detached or separated from the photosensitive member 100, therefore, as shown in FIG. 4, when a toner image 110 is formed to be visible, the amount of the toner adhered to the peripheral edge 111 of the toner image 110 is larger than that adhered to the center portion 112 thereof, resulting in an excessive amount of the toner at the edge of the toner image (which is referred to as "edge effect" hereinafter). The edge effect is closely related to the density of the developing powder just when the developing powder is separated from the photosensitive member 100, and the higher the density of the developing powder at this edge is, the stronger becomes the edge effect.

Therefore, as shown in FIG. 5, when a toner image 110 with an excessive edge effect is fixed by melting onto a recording medium 107 such as a sheet of printing paper, the toners at the peripheral edge 111 of the toner image 110 are spread therearound, so that the edge portion of the toner image 110 is brought into contact with an edge portion of an adjacent toner image, resulting in deteriorating the quality of the image. In particular, when an image of dots is formed, the dots are crushed, so that the quality of the image is remarkably deteriorated.

Referring further to FIG. 6, when toner images 120*a*, 120*b* and 120*c* are overlapped with different colors to form a desired color image 120, the color tone of the image becomes different between an edge portion 121 and a center portion 122 of the image 120, so that the quality of the obtained color image 120 is deteriorated.

A second problem involved in the developing device 101*a* is that, the toners at the leading end or trailing end of the toner image are scraped off by a magnetic brush, so that there occur blurred stripes or scratch patterns at the leading end or trailing end of the image. It is to be noted here that the scratch pattern at the trailing end of the image occurs when the peripheral speed (or peripheral velocity) of the sleeve is faster than that of the photosensitive member 100.

The process of generating the scratch patterns at the trailing end of the image is explained below with reference to FIGS. 7(*a*), 7(*b*) and 7(*c*).

After an electrostatic latent image portion $I_1$ ($V_i = -300$ V) is completely developed in the developing zone Q, an electrostatic latent non-image portion $I_0$ ($V_0 = -50$ V) subsequently proceeds to the developing zone Q, so that the magnetic brush is brought in contact with the non-image portion $I_0$ of the electrostatic latent image. Then, carriers Ca at the tip end of the magnetic brush in contact with the non-image portion $I_0$ are negatively charged with a polarity opposite to that of the toners To at the surface thereof confronting to the outer surface of the photosensitive member 100. This is because the toners To (positively charged) adhered to the carriers Ca are attracted by a developing bias voltage ($V_B = -150$ V) applied to the sleeve 102 and is moved to the sleeve (upward in the drawings), with leaving the negative electric charges behind. In consequence, the toners To at the trailing end of the image which are adhered to the outer surface of the photosensitive member 100 are contacted with the carriers Ca positioned at the tip end of the magnetic brush and the toners To are scraped off by the magnetic brush due to the mechanical contacting force and electric suction force of the carriers Ca. As a result, the traces of the scraped mark appear as the scratch patterns on the image. In the same manner as above, there appear scratch patterns also at the leading end of the image.

A third problem of the developing device 101*a* is an occurrence of a so-called blank printing or a white stripe at the leading end of an image of low density when it is followed by an image of high density. It is to be noted that the white lines due to the blank printing are caused when the peripheral speed of the sleeve is faster than that of the photosensitive member.

The process to cause the white lines due to the blank printing will be described with reference to FIGS. 8(*a*) through 8(*c*).

In the case where an electrostatic latent image $I_1$ of a low density image ($V_{l1}=-300$ V) is followed by an electrostatic latent image $I_2$ of a high density image ($V_{l2}=-600$ V), the electrostatic latent images $I_1$ and $I_2$ are sequentially developed in the developing zone Q. At this time, when the carriers Ca of the magnetic brush which lost the toners To during the development of the latent image $I_2$ catch up in contact with the toners adhered to the electrostatic latent image $I_1$, the toners To adhered to the trailing end of the latent image $I_1$ are scraped off by the scraping force of the magnetic brush and the electric suction force generated between the toners adhered to the photosensitive member 100 and electric charges left after the carriers lose the toners. Consequently, the blank printing occurs where the toners are scraped off in the image.

A fourth problem is encountered in the developing device which is provided with a regulator plate 104 confronting to the outer peripheral surface of the sleeve with a very small clearance maintained therefrom to control the amount of the powder developers transported to the developing zone Q. When foreign substances such as a mass of toners or paper dust or the like clog between the regulator plate 104 and the sleeve 102. In such case, the developer 106 is interrupted by the foreign substances from being transported to the developing zone Q, and the resultant image has white lines due to blank printing where the image is lost.

As shown in FIG. 9, a fifth problem is that one or more carriers Ca losing the toners during the development of the image are adhered to the photosensitive member 100 due to a snake (runaround) electric field E generated in the boundary between the image part (−600 V zone) and the non-image part (−50 V zone).

(b) DOUBLE POLE TYPED DEVELOPING DEVICE 101*b*

Similar to the developing device 101*a* of the single pole type discussed above, the developers when separated from the photosensitive member 100 are of high density in the developing device 101*b*, and therefore it cannot be avoid that the edge effect is emphasized excessively, the leading or trailing end of the image is scratched, white lines due to blank printing is caused at the leading end of the image, carriers are undesirably adhered to the photosensitive member.

However, since two adjacent magnetic brushes 106*a* and 106*b* are formed confronting to the photosensitive member 100 in the developing device 101*b*, when the powder developer 106 leaps from the first magnetic brush 106*a* to the second magnetic brush 106*b*, the developer 106 is stirred in an axial direction of the sleeve 102, i.e., in a three-dimensional direction.

Therefore, even when the toners are hindered by a foreign substance hooked at a clearance between the sleeve and the end of the regulator plate 104 thereby to form a portion without the developer, the portion is compensated by the developers in the neighborhood. Accordingly, there is not generated a white line where the image is lost.

(c) INNER POLE ROTARY TYPED DEVELOPING DEVICE 101*c*

In the developing device 101*c* of a inner pole rotary type, involved are such defects that, the edge effect is too strong, and carriers are adhered to the photosensitive member more in comparison with the developing device of the inner pole fixed type described above.

The reason for the excessive edge effect is the same as noted with reference to the inner pole fixed typed developing devices 101*a* and 101*b*.

The reason for the adhesion of a large amount of carriers is found in that the centrifugal force acting on the carriers is larger in the developing device 101*c* than in the developing devices 101*a* and 101*b* since the ear of the developer 106 is rotated together with the magnet member 103 at a high speed in the device 101*c*. Moreover, the suction force to the developer when separated from the photosensitive member 100 varies periodically as the developer passes the magnetic poles.

In this device 101*c*, the scratch patterns are not caused at the leading or trailing end of the image because of the following reasons which will be described below with reference to FIGS. 10(*a*) to 10(*c*).

When the non-image part $I_0$ advances to the developing zone after the completion of the development of the image part $I_1$, in the magnetic brush contacted with the non-image part $I_0$ of the electrostatic latent image, the toners positively charged are attracted by the developing bias voltage $V_B$ (=−150 V) of the sleeve 102 towards the side of the sleeve, resulting in that negative charges of a polarity opposite to that of the toners appear at the surface of the sleeve 102 confronting to the photosensitive member 100. However, since the carriers Ca are moved towards the sleeve 102 (upward in the drawing) in accordance with the rotation of the magnet member 103, there is not effected an electric suction between the carriers Ca and the toners To adhered to the image part $I_1$ of the electrostatic latent image. Accordingly, the toners at the leading or trailing end of the image are not scraped off, preventing the occurrence of any scratch pattern on the obtained image.

The reason for preventing the occurrence of the white line of blank printing will be described with reference to FIGS. 11(*a*) to 11(*c*).

The carriers Ca losing the toners during the development of the electrostatic latent image $I_1$ of low density and electrostatic latent image $I_2$ of high density retreat from the end of the magnetic brush toward the surface of the sleeve 102 as the magnet member 103 is rotated. Therefore, it never happens that the carriers Ca losing the toners To are brought into contact with the toners To adhered to the photosensitive member 20 to scrape the latter toners. For this reason, the white line of blank printing is not caused on the image.

The white lines are not caused even when the foreign substances clog at the end of the regulator plate. This is because the developer is stirred in a three-dimensional direction by the rotation of the magnet member 103, whereby the portion where the developer is removed is filled with the foreign substances in the neighborhood thereof.

The drawbacks mentioned above of the conventional developing devices, 101*a*, 101*b* and 101*c* are summed up in Table 1 below.

TABLE 1

| DRAWBACK | SINGLE POLE TYPE 101a | DOUBLE POLE TYPE 101b | POLE ROTARY TYPE 101c |
|---|---|---|---|
| (1) | X | X | X |
| (2) | X | X | ○ |
| (3) | X | X | ○ |
| (4) | X | ○ | ○ |
| (5) | Δ | Δ | X |

REMARKs
(1): EXCESSIVE EDGE EFFECT
(2): SCRATCH PATTERN AT LEADING OR TRAILING END
(3): WHITE PORTION AT LEADING END
(4): WHITE LINE CAUSED BY CLOG OF FOREIGN SUBSTANCE
(5): ADHESION OF CARRIERS
X: NO PROBLEM
Δ: SLIGHTLY PROBLEMATIC
○: PROBLEM

SUMMARY OF THE INVENTION

It is an object of the present invention to eliminate such problems as mentioned above and its essential object is to provide a developing device for use in an image forming apparatus for forming an image of uniform density without generating a scratch pattern or white lines.

The developing device of the present invention is a double pole type developing device of an inner pole fixed type, which includes a developing roller 1 comprising a magnet member 3 non-rotatably fixed and a sleeve 2 rotatably moved around the outer surface of the magnet member 3, wherein powdery developer D held on the outer periphery of the sleeve 2 are brought into contact with a photosensitive member 10 thereby to visualize an electrostatic latent image. The magnet member 3 is provided with a magnetic pole portion $N_0$ consisting of first and second magnetic poles $N_1$ and $N_2$. The first and second magnetic poles $N_1$ and $N_2$ have an identical polarity and the situations thereof are adjacent to each other with a predetermined distance in the outer peripheral portion of the magnet member 3 confronting to the photosensitive member 10. The powdery developers D consisting of three developer parts, i.e., an upstream part $D_1$, an intermediate part $D_{12}$ and a downstream part $D_2$, are successively retained on the outer surface of the sleeve 2 by the magnetic forces of the first and second magnetic poles $N_1$ and $N_2$ both facing to the photosensitive member 10. The upstream part of the developer $D_1$ retained by the first magnetic pole $N_1$ situated at the upstream side in a rotational direction of the sleeve and the intermediate part of the developer $D_{12}$ retained by the middle portion between the first and second magnetic poles $N_1$ and $N_2$ are brought into contact with the photosensitive member, while the downstream part of the developer $D_2$ retained by the second magnetic pole $N_2$ situated at the downstream side in a rotating direction of the sleeve is held without contact with the photosensitive member.

According to another feature of the present invention, the developing device of the present invention may be provided with another magnet member 12 or a magnet field generating means having a polarity different from that of the second magnetic pole $N_2$ adjacent and facing thereto below the lower developing zone corresponding to the lower developer $D_2$ in the downstream direction of the rotation of the sleeve. (see FIG. 20)

In the construction of the image forming apparatus according to the present invention, there may be provided a second magnet member 25 inside the photosensitive member 10, wherein a pair of magnetic poles ($S_1'$, $S_2'$) of the second magnet member 25 having the same polarities as those of the magnetic poles ($S_1$, $S_2$) are arranged to face the magnetic pole portion $N_0$ consisting of the first and second magnetic poles $N_1$ and $N_2$ (see FIG. 26)

Moreover, in the construction of the image forming apparatus of the present invention, there may be employed a roller transfer type apparatus, wherein a transfer sheet 40 is introduced passing through a nip portion 50 defined between a photosensitive member 32 and a transfer roller 38 depressed thereto, whereby the toner image formed on the photosensitive member 32 is transferred to the transfer, sheet 40. (see FIG. 27)

In the developing device employed in the image forming apparatus according to the present invention, in the intermediate developing zone corresponding to the middle developer part $D_{12}$ between the upper developer $D_1$ and the lower developer $D_2$ respectively corresponding to the first and second magnetic poles $N_1$ and $N_2$ of the same polarities in the space between the photosensitive member 10 and the sleeve 2 facing to each other, the magnetic fields $H_1$ and $H_2$ of the first and second magnetic poles $N_1$ and $N_2$ are repulsed each other and a repulsive magnetic field $H_0$ is generated, which works between the two magnetic poles $N_1$ and $N_2$ of the same polarities. Therefore, the upper developer part $D_1$ transferred to the upper developing zone corresponding to the first magnetic pole $N_1$ in the upstream side of the rotation of the sleeve 2 is tightly held by the magnetic force of the first magnetic pole $N_1$, and since the repulsive magnetic field $H_0$ is generated in the middle developing zone below the upper developing zone, a mass of developers of high density is formed at a upper developing zone corresponding to the first magnetic pole $N_1$ where the developers D are stirred. Then, the upper developer $D_1$ held by the first magnetic pole $N_1$ is pushed downward by the developers D sequentially fed from the upstream side so that the upper developer $D_1$ is fed to the downstream side as it is being retained on the outer surface of the sleeve 2, in other words, without leaping of the developer D. Herein, since the repulsive magnetic field $H_0$ is generated in the intermediate developing zone between the upper and lower developing zones corresponding to the first and second magnetic poles $N_1$ and $N_2$ respectively, the middle developer $D_{12}$ passing through the intermediate developing zone is in a state of low density. The lower developer $D_2$ corresponding to the second magnetic pole $N_2$ in the downstream side of the sleeve rotation is tightly held by the magnetic force of the second magnetic pole $N_2$. However, in the downstream side below the second magnetic pole $N_2$, since there is not formed a repulsive magnetic field such as a magnetic field $H_0$, the transfer of the developers fed downward is not prevented, and therefore a mass of developers of high density is not formed.

The electrostatic latent image formed on the photosensitive member 10 is developed to be visualized by contacting the upper developer $D_1$ and middle developer $D_{12}$ with the photosensitive member 10. That is to say, the end of the development is conducted by contacting the developer of the lowest density with the photosensitive member 10.

In the developing device which is provided with the magnet member 12 or magnetic field generating means as mentioned in the feature of the present invention, the lower developer part $D_2$ fed in the lower developing zone corresponding to the second magnetic pole $N_2$ is caught by a magnetic field generated between the second magnetic pole $N_2$ and the magnet member 12, so that the developer $D_2$ does not fall down or leap therearound. Moreover, the lower developer part $D_2$ retained by the second magnetic pole $N_2$ in the downstream side of the sleeve rotation is kept from contact with the photosensitive member 10.

In the image forming apparatus provided with the second magnet member 25 inside the photosensitive member 10 as mentioned in the feature of the present invention, the lower developer part $D_2$ retained by the magnetic pole $S_2$ in the downstream side is kept from contact with the photosensitive member 10 due to the repulsive magnetic field generated between the two magnet bodies 3 and 25.

In the image forming apparatus of a roller transfer type, since a toner image with a low edge effect is formed on the photosensitive member by the developing device mentioned above, it is avoided that the toner image is spread when the developed image is transferred to the transfer sheet, thereby preventing the deterioration of the quality of the image.

BRIEF DESCRIPTION OF THE DRAWINGS

The present invention will become more fully understood from the detailed description given hereinbelow and the accompanying drawings which are given by way of illustration only, and these are not limitative of the present invention, and wherein.

DETAILED DESCRIPTION OF THE PREFERRED EMBODIMENT

Figure 1:
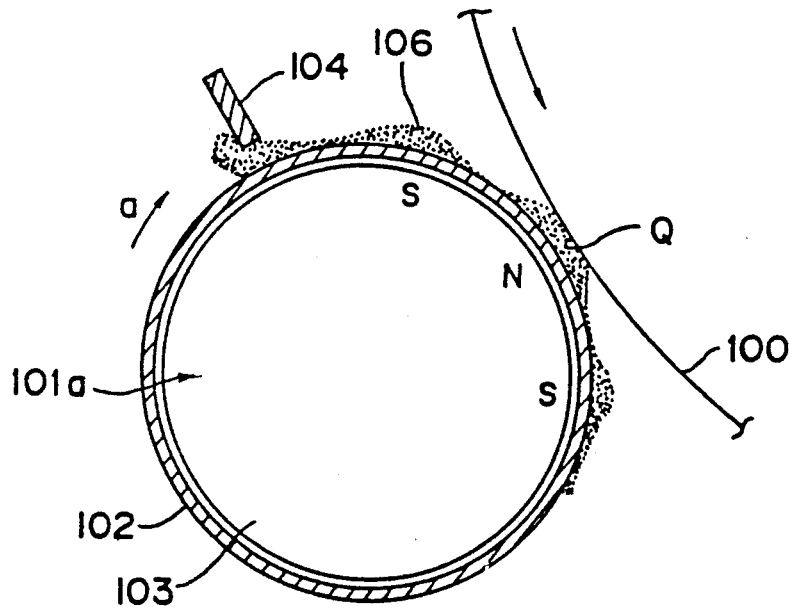
Fig. 1 (Prior Art)
FIG. 1 is a partial sectional view of a conventional single pole type developing device.
Figure 2:
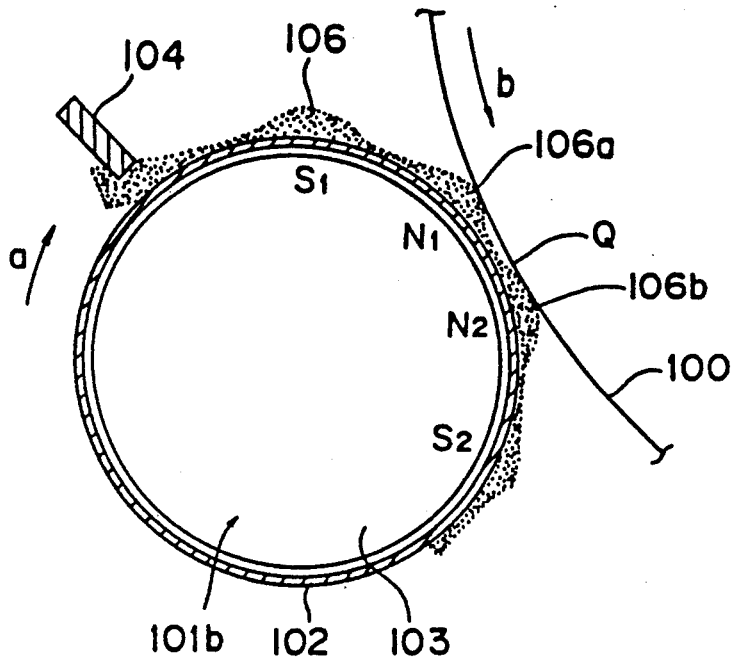
Fig. 2 (Prior Art)
FIG. 2 is a partial sectional view of a conventional double pole type developing device.
Figure 3:
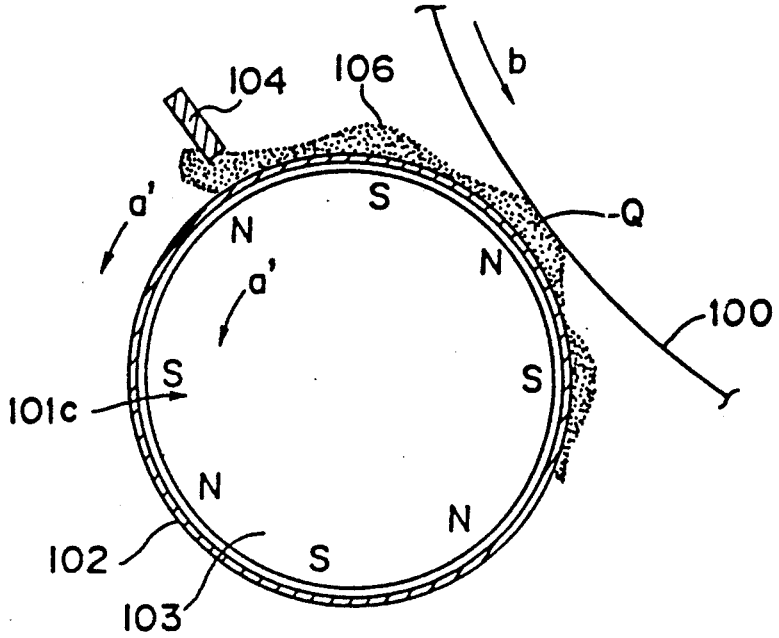
Fig. 3 (Prior Art)
FIG. 3 is a partial sectional view of a conventional developing device of an inner pole rotary type.
Figure 4:
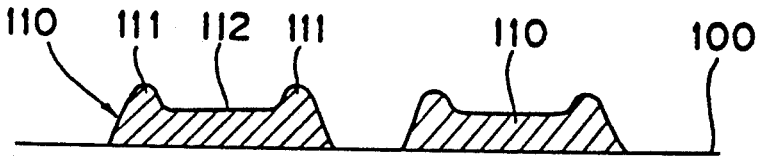
Fig. 4 (Prior Art)
FIG. 4 is a sectional view of a toner image with an excessive edge effect.
Figure 5:
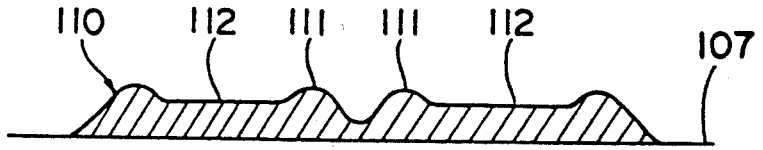
Fig. 5 (Prior Art)
FIG. 5 is a sectional view of a fixed toner image.
Figure 6:
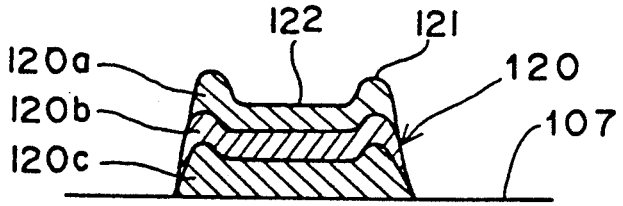
Fig. 6 (Prior Art)
FIG. 6 is a sectional view of a fixed tone image with different three colors.
Figure 9:
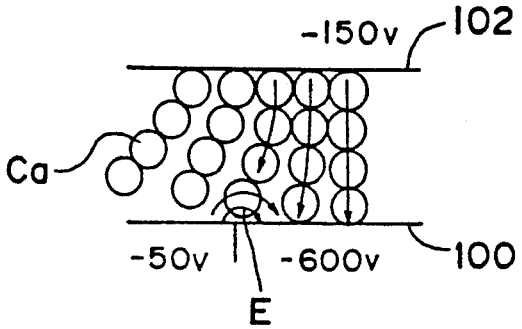
Fig. 9 (Prior Art)
FIG. 9 is a schematic diagram showing a state of a magnetic field at a boundary of the image.
Figure 7A:
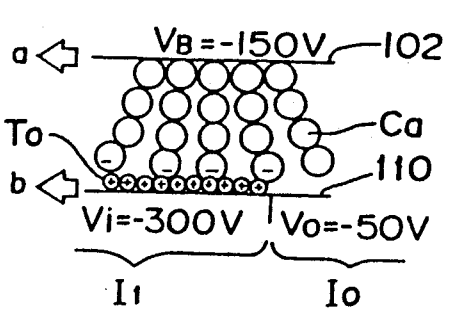
Fig. 7(a) (Prior Art)
FIGS. 7(*a*) to 7(*c*) are schematic diagrams explaining a generation of a scratch pattern caused in the leading or trailing edge of the image.
Figure 7B:
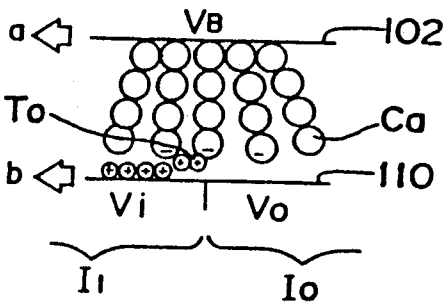
Fig. 7(b) (Prior Art)
Figure 7C:
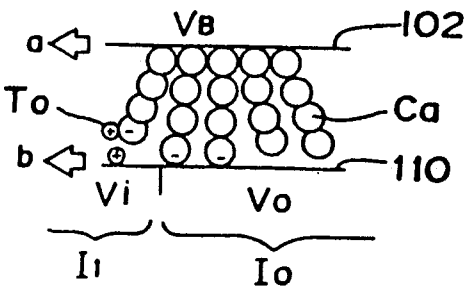
Fig. 7(c) (Prior Art)
Figure 8A:
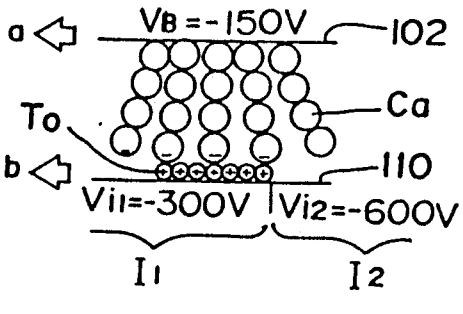
Fig. 8(a) (Prior Art)
FIGS. 8(*a*) to 8(*c*) are schematic diagrams explaining a generation of a white line due to blank printing.
Figure 8B:
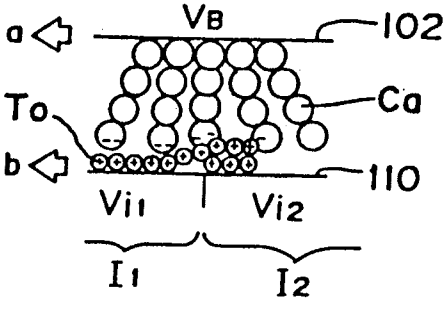
Fig. 8(b) (Prior Art)
Figure 8C:
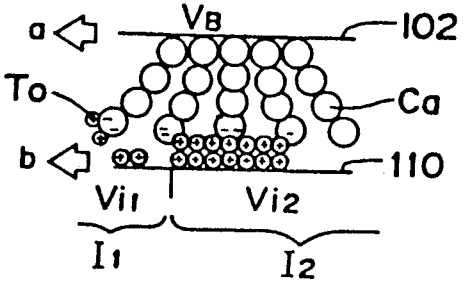
Fig. 8(c) (Prior Art)
Figure 10A:
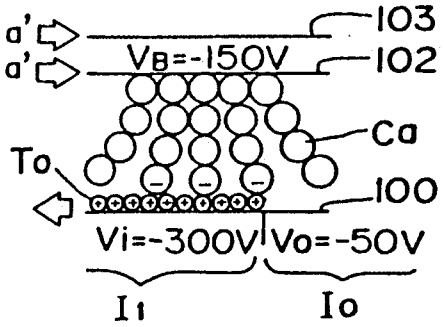
FIGS. 10(*a*) to 10(*c*) and 11(*a*) to 11(*c*) are schematic diagrams explaining a state of developers in a developing zone in the conventional developing device of an inner pole rotary type.
Figure 10B:
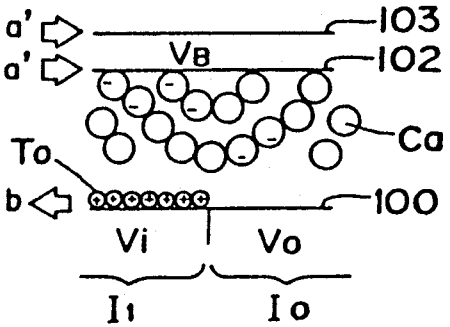
Figure 10C:
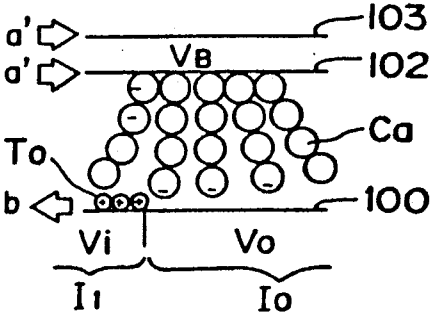
Figure 11A:
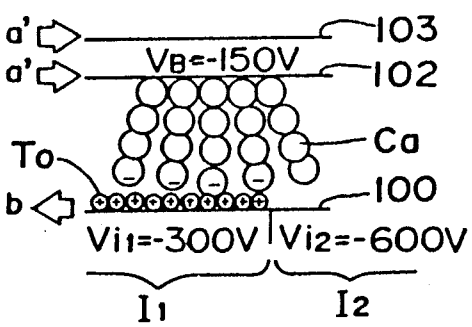
Figure 11B:
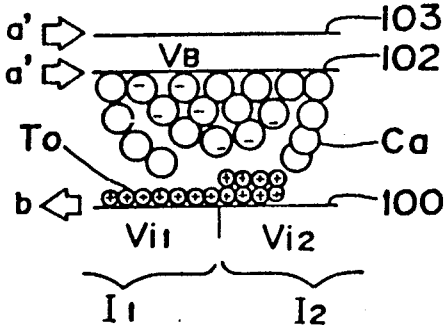
Figure 11C:
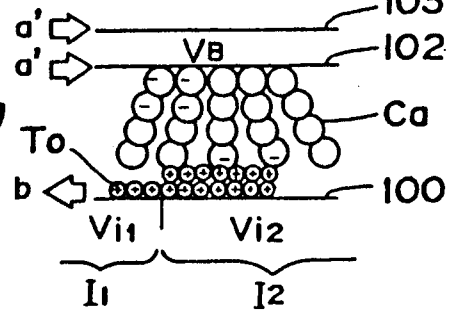

Before the description of the present invention proceeds, it is to be noted that like parts are designated by like reference numerals throughout the accompanying drawings.

Preferred embodiments of the present invention will now be described hereinbelow with reference to FIGS. 12 to 29.

Figure 12:
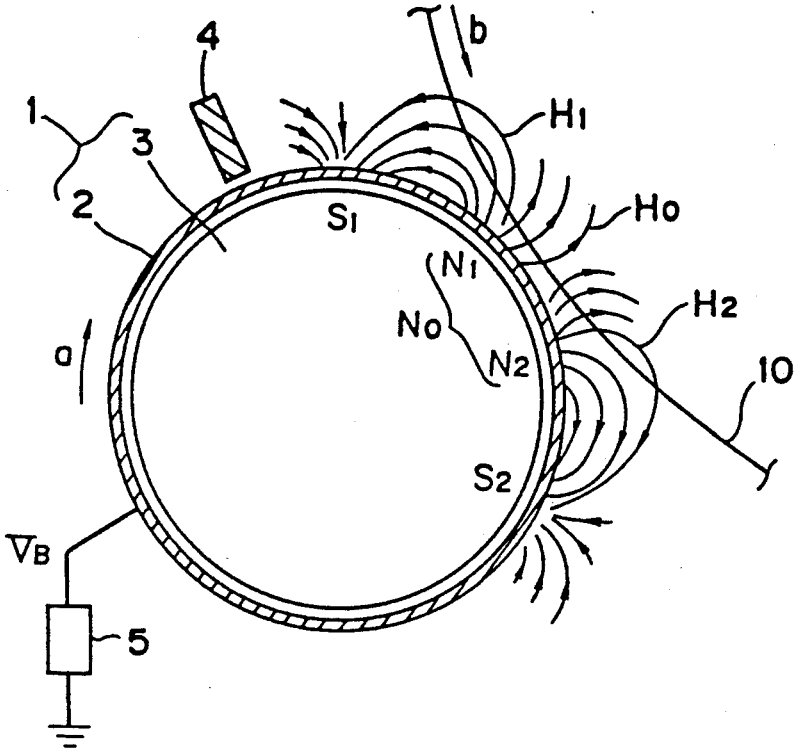
FIG. 12 is a partial cross sectional view of a developing device according to the present invention.

FIG. 12 shows a developing unit of a developing device according to the present invention. The developing device of the present invention is a kind of double pole type developing device which includes a developing roller 1 and a photosensitive member 10. The developing roller 1 is composed of a sleeve 2 and a magnet member 3 accommodated therein. The sleeve 2 is rotated in a direction shown by an arrow a and the magnet member 3 is non-rotatably fixed. The sleeve 2 is spaced a predetermined gap from a confronting portion of an outer surface of the photosensitive member 10. The magnet member 3 is provided with a plurality of pairs of magnetic poles N and S alternately arranged in the outer periphery of the magnet member 3, each of the poles extending in an axial direction of the sleeve 2. More specifically, a double pair of magnetic poles ($N_1$, $S_1$) and ($N_2$, $S_2$) are respectively arranged in the upstream side and downstream side in a rotating direction of the sleeve 2 in such a manner that a first magnetic pole $N_1$ and a second magnetic pole $N_2$ of the same polarities adjacently face to each other in the outer peripheral portion of the magnet member 3 confronting to the photosensitive member 10, thereby constructing a double magnetic pole portion $N_0$ consisting of $N_1$ and $N_2$ of the same polarities. Moreover, a magnetic pole $S_1$ of a polarity opposite to that of the magnetic pole $N_1$ and a magnetic pole $S_2$ of a polarity opposite to that of the magnetic pole $N_2$ are arranged at the upper and lower sides of the magnetic poles $N_1$ and $N_2$ respectively.

The first and second magnetic poles $N_1$ and $N_2$ generate a first magnetic field $H_1$ and a second magnetic field $H_2$ respectively, thereby generating a repulsive magnetic field $H_0$ in the intermediate portion between the first and second magnetic fields $H_1$ and $H_2$.

Figure 13:
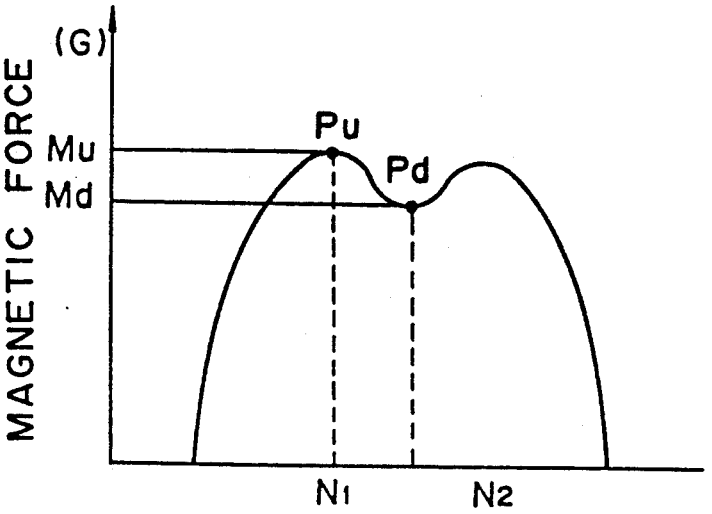
FIG. 13 is a graph showing a distribution of a magnetic force of a double pole type developing device according to the present invention.

The distance between the first and second magnetic poles $N_1$ and $N_2$ is set in such a manner that, in a distribution of the magnetic forces of the first and second magnetic poles $N_1$ and $N_2$ as shown in FIG. 13, there are formed a peak point Pu corresponding to the magnetic pole $N_1$ and a trough (represented by a point Pd) in the intermediate portion between the two magnetic poles $N_1$ and $N_2$ and that a magnetic force Md corresponding to the trough Pd is set in a range of 60 to 90 percentage of the peak value Mu of the magnetic force corresponding to the peak point Pu.

In the structure of the developing device mentioned above, powdery developers of two components composed of toners and carriers are fed to the developing roller 1 and retained in the outer peripheral surface of the sleeve 2 owing to the magnetic force of the magnet member 3. The retained developers are transported in a direction shown by the arrow a in accordance with the rotation of the sleeve 2. The transporting amount of the developers is regulated at an end of a regulator plate 4. After passing through a slit between the end of the regulator plate 4 and the corresponding upper surface of the sleeve 2, the developers are transported through the magnetic pole $S_1$ to the magnetic pole $N_1$ and passed through the vicinity of the confronting part between the sleeve 2 and the photosensitive member 10 so as to be transported to the lower side of the second magnetic pole $N_2$.

Owing to the arrangement of the magnetic poles $S_1$, $N_1$, $N_2$ and $S_2$ as mentioned above, the first and second magnetic fields $H_1$ and $H_2$ are generated between the magnetic poles $N_1$ and $S_1$, $N_2$ and $S_2$ respectively. The lines of magnetic force generated by the magnetic poles $N_1$ and $N_2$ are respectively directed towards the magnetic poles $S_1$ and $S_2$. The magnetic fields $H_1$ and $H_2$ are repulsive between the two magnetic poles $N_1$ and $N_2$ so as to form the repulsive magnetic field $H_0$ in the intermediate portion between the two magnetic poles $N_1$ and $N_2$.

Figure 14:
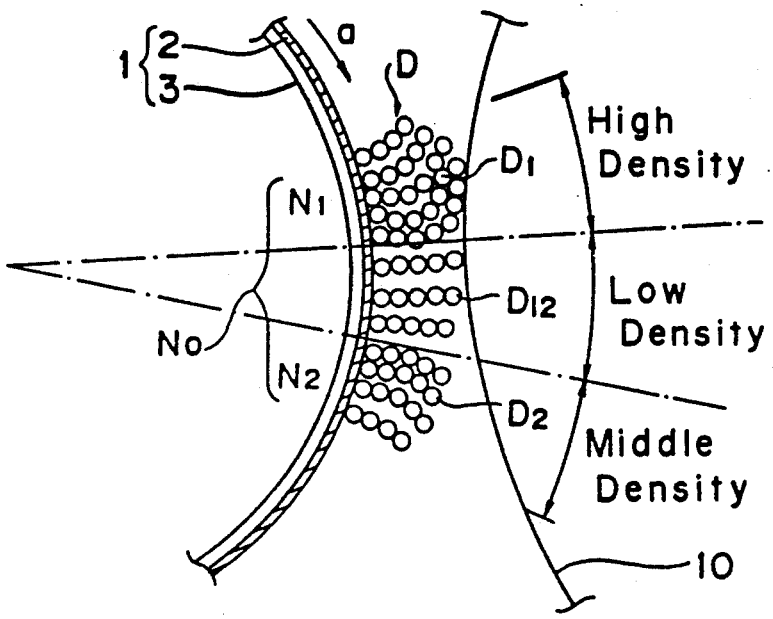
FIG. 14 is an explanatory diagram showing a state of developers in the developing device of the present invention.

Therefore, as shown in FIG. 14, the upper part $D_1$ of the developer D transported to the upper developing zone corresponding to the first magnetic pole $N_1$ is securely retained by the magnetic force of the first magnetic pole $N_1$ forming a magnetic brush and is inclined along the first magnetic field $H_1$ in an upward direction counter to that of the rotation of the sleeve 2. Accordingly, the developer part $D_1$ retained by the first pole $N_1$ forms a mass of developers in which the developer part $D_1$ is stirred in the three dimensional directions.

The developer part $D_1$ retained by the magnetic pole $N_1$ is pushed downward by a succeeding developer part D transported from the upstream side thereof so that the developer part $D_1$ is sequentially pushed ahead to the lower developing zone corresponding to the second magnetic pole $N_2$ through the middle developing zone corresponding to the intermediate portion between the two magnetic poles $N_1$ and $N_2$. Herein, since the intensity of the magnetic force Md corresponding to the trough Pd at the intermediate portion of the two magnetic poles $N_1$ and $N_2$ is set in the range of 60 to 90 percentage of the magnetic force Mu corresponding to the peak portion Pu, therefore the middle part $D_{12}$ of the developer retained by the intermediate portion between the two magnetic poles $N_1$ and $N_2$ on the sleeve 2 is also retained in a state of the magnetic brush. That is to say, the developer D is transported from the upper developing zone corresponding to the first magnetic pole $N_1$ to the lower developing zone corresponding to the second magnetic pole $N_2$ through the middle developing zone preventing the developer from leaping. However, since the magnetic fields $H_1$ and $H_2$ are repulsive in the intermediate portion of the two magnetic poles $N_1$ and $N_2$, the density of the middle part $D_{12}$ of the developer is extremely low so that the outer surface of the sleeve 2 can be visually observed through the developer part $D_{12}$.

Subsequently, the developer passing through the middle developing zone is securely retained on the outer surface of the sleeve 2 by the magnetic force of the second magnetic pole $N_2$. However, since there is not present a magnetic pole of the same polarity as that of the magnetic pole $N_2$ in the lower side of the magnetic pole $N_2$, the lower part $D_2$ of the developer retained by the second magnetic pole $N_2$ is smoothly transported downward to the magnetic pole $S_2$ without forming a mass of developers. Therefore, the lower developer part $D_2$ has a middle density which is higher than that of the middle developer part $D_{12}$ and lower than that of the upper developer part $D_1$.

Among the developers D transported to the developing zone as described above, the upper and middle parts $D_1$ and $D_{12}$ of the developer retained by the first magnetic pole $N_1$ and the intermediate portion of the two magnetic poles $N_1$ and $N_2$ respectively are brought into contact with the photosensitive member 10, while the lower part $D_2$ of the developer is held without contact with the photosensitive member 10. At this time, when an electrostatic latent image is formed on the surface of the photosensitive member 10, toners of the developers are adhered to the image part of the electrostatic latent image depending on the electrostatic contrast between the potential of the electrostatic latent image and a bias voltage $V_B$ supplied to the sleeve 2 from a power source 5. That is to say, the development of the electrostatic latent image formed on the photosensitive member 10 is completed by contacting the middle developer part $D_{12}$ with the photosensitive member 10, while the lower developer part $D_2$ of the middle density is retained by the second magnetic pole $N_2$ without contact with the photosensitive member 10.

Figure 15:
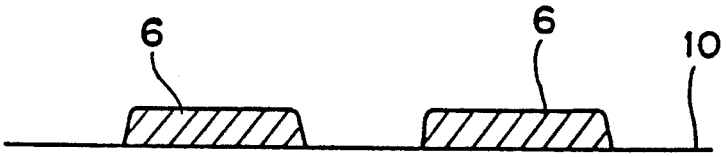
FIG. 15 is a sectional view showing a state of adhered toners.

Therefore, it can be prevented that the amount of the toners adhered to the edge of the electrostatic latent image is excessively larger than that of the toners adhered to the central portion surrounded by the edge thereof. Accordingly, as shown in FIG. 15, the toners 6 are adhered uniformly by approximately the same amount all over the electrostatic latent image with weak edge effect avoiding such an excessive edge effect as caused in the conventional developing device.

Figure 16:
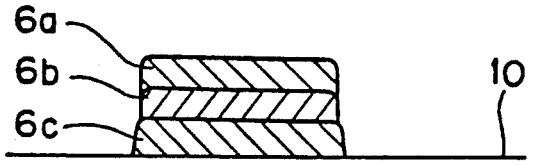
FIG. 16 is a sectional view of an overlapped toner image.

Moreover, as shown in FIG. 16, even when toner images 6*a*, 6*b* and 6*c* of different colors are overlapped, the total color tone is rendered uniform.

Figure 17A:
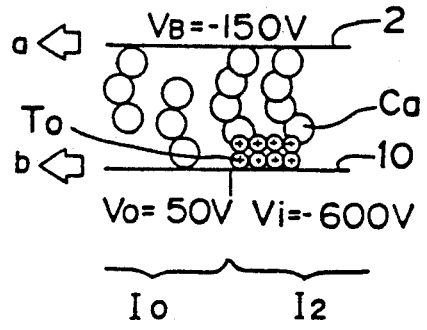
FIGS. 17(*a*) to 17(*c*) are schematic diagrams showing a leaping of toners caused by leap of developers.
Figure 17B:
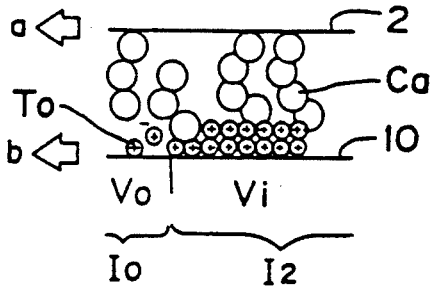
Figure 17C:
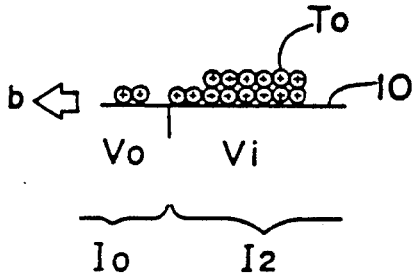

Moreover, in the developing device of the present invention, since the lower developer part $D_2$ is not in contact with the photosensitive member 10, occurrence of a toner fog is avoided in the front portion of the image part. That is, in the conventional developing device as shown in FIGS. 17(*a*) to 17(*c*), when the leaped developer collides against the surface of the photosensitive member 10, the toners To adhered to an image part $I_2$ of the electrostatic latent image are flipped out and the flipped toners To are in turn adhered to a non-image part $I_0$, thereby causing a toner fog. In the image forming apparatus of the present invention, however, the developer D is always held on the outer surface of the sleeve 2 without colliding directly against the photosensitive member 10, and therefore the toner fog through collision of the developer to the photosensitive member 10 is avoided.

In a similar manner to this, contamination of the inside of the image forming apparatus can be prevented because the leaping of developers is suppressed. That is to say, in the conventional device, when the leaped developers are attracted and retained again onto the surface of the sleeve 2, a large amount of the toners are scattered from the tips of the magnetic brush due to the shock of the adhesion of the developers, thereby causing a toner fog or contamination of the apparatus. In the developing device of the present invention, however, since the developers are always held on the outer surface of the sleeve 2, the toner fog and contamination of the device can be avoided.

As shown in FIG. 12, in the upper developing zone corresponding to the first magnetic pole $N_1$, since the lines of magnetic force of the first magnetic field $H_1$ are extended towards the magnetic pole $S_1$, therefore the magnetic brush is laid down along the direction of the magnetic field $H_1$ so that the developer at the end of the magnetic brush is affected by a force directed towards the magnetic pole $S_1$ from the magnetic pole $N_1$ which is inverse to the transporting direction of the developer.

Figure 18A:
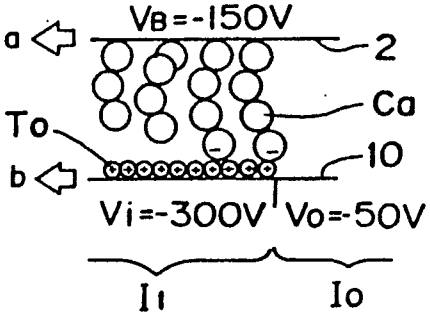
FIGS. 18(*a*) to 18(*c*) and 19(*a*) to 19(*c*) are schematic diagrams showing a state of the developers in the developing device.
Figure 18B:
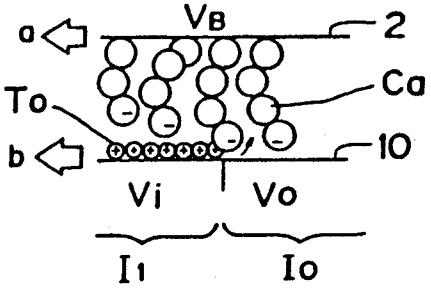
Figure 18C:
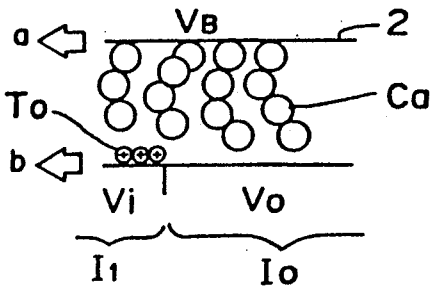

Referring further to FIGS. 18(*a*) to 18(*c*), in the magnetic brush which is in contact with the non-image part $I_0$ of the electrostatic latent image, the toners retained by the carriers Ca are electrically attracted to the side of the sleeve 2 by the developing bias voltage $V_B(=-150$ V), and the carriers confronting to the photosensitive member 10 are electrically charged with polarities opposite to those of the toners. However, since the magnetic brush is affected by the force of an inverse direction to the transporting direction of the developer, the carriers at the end of the magnetic brush are moved towards the sleeve 2 (upward in the drawing). Therefore, the electric force of the carriers Ca to scrape the toners is small, thus avoiding the generation of scratch patterns at the leading or trailing end portion of the image.

Figure 19A:
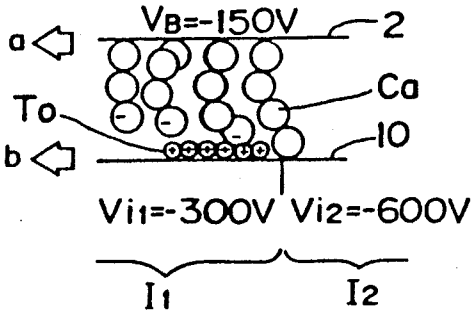
Figure 19B:
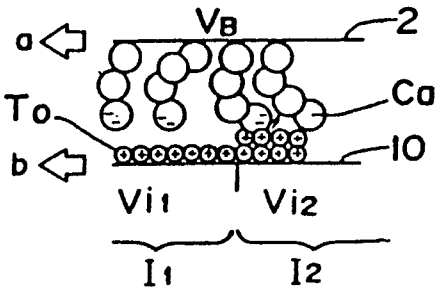
Figure 19C:
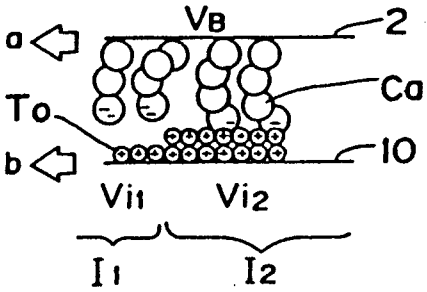

Likewise, as shown in FIGS. 19(*a*) to 19(*c*), even when an electrostatic latent image $I_2$ of a high density image follows an electrostatic latent image $I_1$ of a low density image, it is prevented that the toners at the trailing end of the low density image are scraped by the magnetic brush thereby to cause a white portion due to blank printing at the leading end of the image.

In addition, since the developers retained by the first magnetic pole $N_1$ are stirred in a three-dimensional direction, even if a foreign substance clogs between the regulator plate 4 and the sleeve 2, the developers can be supplied to a part where the developer is removed by the foreign substance. Accordingly, the obtained image has no part with the image lost, i.e., has no white lines.

Furthermore, since the developers are in a state of low density just when the developers are separated from the photosensitive member 10, therefore the carriers having their toners lost are little caught by the snake (or runaround) electric field around the edge of the electrostatic latent image, thereby suppressing the adhesion of the carriers to the photosensitive member 10.

The occurrence of problems such as toner fog and the like was observed in the developing device of the present invention with variation of the magnetic forces of the first and second magnetic poles $N_1$ and $N_2$ of the same polarity and variation of the distance or arrangement relation between the two magnetic poles $N_1$ and $N_2$.

The results of five experiments about the observation items of (1) toner fog, (2) excessive edge effect, (3) white portion due to blank printing at the leading part and (4) white line due to absence of developer caused by foreign substance are summed up in Table 2 below, wherein the outer diameter of the sleeve was 24.5 mm, the peripheral speed of the sleeve was 38 cm/sec. and the peripheral speed of the photosensitive member was 25 cm/sec.

TABLE 2

| EXPERIMENTs | Mu (G) | Md (G) | Md/Mu | (1) | (2) | (3) | (4) |
|---|---|---|---|---|---|---|---|
| EXPERIMENT (1) | 1,000 | 1,000 | 1.0 | ○ | X | X | X |
| EXPERIMENT (2) | 1,200 | 1,080 | 0.9 | ○ | Δ | Δ | Δ |
| EXPERIMENT (3) | 1,160 | 920 | 0.79 | ○ | ○ | ○ | ○ |
| EXPERIMENT (4) | 1,200 | 830 | 0.69 | Δ | ○ | ○ | ○ |
| EXPERIMENT (5) | 1,580 | 780 | 0.49 | X | ○ | ○ | ○ |

REMARKs
○: NO PROBLEM
Δ: SLIGHTLY PROBLEM
X: PROBLEM IN PRACTICAL USE

As shown in Table 2, in the case of (a) Md/Mu=1.0, there occurred problems in the observation items (2), (3) and (4). In the case of (b) Md/Mu=0.69~0.9, there occurred no problem in the items (1) to (4). In the case of (c) Md/Mu=0.49, there occurred a problem in the item (1).

Accordingly, when the value of Md/Mu is set in the range of approximately 0.6 to 0.9, the developers are held also in the intermediate portion between the two magnetic poles $N_1$ and $N_2$ and the development of the electrostatic latent image is completed by the developers retained by the intermediate portion of the magnetic poles $N_1$ and $N_2$. In this case, therefore, an image of high quality can be obtained without occurrence of toner fog, excessive edge effect, white portion due to blank printing in the leading part and of white line due to lost image by the foreign substance.

Moreover, in this first embodiment, a second magnet member may be further provided inside the photosensitive member 10 in such a manner that the two magnetic poles of the second magnet member having the same polarities as those of the first and second magnetic poles $N_1$ and $N_2$ are arranged to confront to the first and second magnetic poles $N_1$ and $N_2$.

Figure 20:
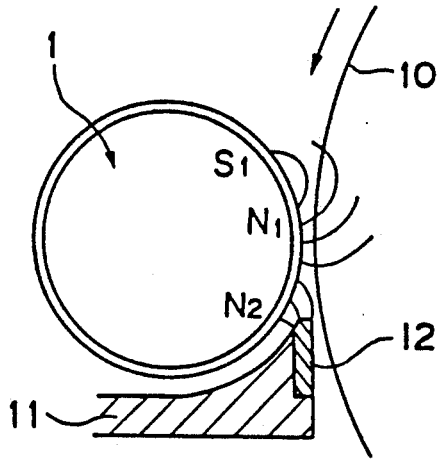
FIG. 20 is a partial sectional view of a developing device provided with a second magnet member.

According to a second preferred embodiment of the developing device, as shown in FIG. 20, there is provided a casing 11 below the developing roller 1, the casing 11 extending to the vicinity of the confronting portion between the second magnetic pole $N_2$ and the photosensitive member 10, wherein a magnetic member 12 may be provided in the end of the casing 11 corresponding to the confronting portion between the second magnetic pole $N_2$ and the photosensitive member 10. Moreover, in order to restrict the dispersion of toners at the magnetic pole $N_2$, the magnetic pole $N_2$ may be provided inside the casing 11. At the same time, by this construction, the developer is prevented from falling out of the developing device when the developer is transported from the magnetic pole $N_1$ to the magnetic pole $N_2$, and also the leaping developer is prevented from being brought into contact with the photosensitive member 10. This is because, when the developer is transported from the upper developing zone corresponding to the first magnetic pole $N_1$ to the lower developing zone corresponding to the second magnetic pole $N_2$, the transported developer is caught by a magnetic field generated between the magnetic member 12 and the magnetic pole $N_2$. Therefore, there can be obtained an image of high quality without occurrence of a toner fog, avoiding the contamination inside the apparatus.

Figure 21:
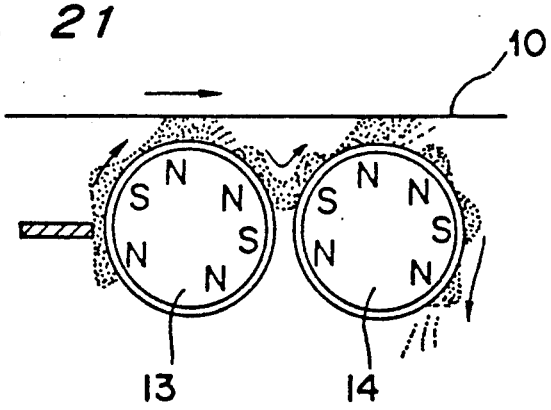
FIGS. 21 to 23 are partial sectional views each showing an essential part of a developing device.

Although the developing device is provided with a single developing roller 1 as shown in the above embodiment, there may be provided a plurality of developing rollers at the lateral side of the photosensitive member 10 in a third embodiment, for example, two developing rollers 13 and 14 as shown in FIG. 21, whereby an electrostatic latent image is developed twice by using the two developing rollers 13 and 14. According to this embodiment, a flat image with weak edge effect can be obtained in such a high-speed copying machine.

Figure 22:
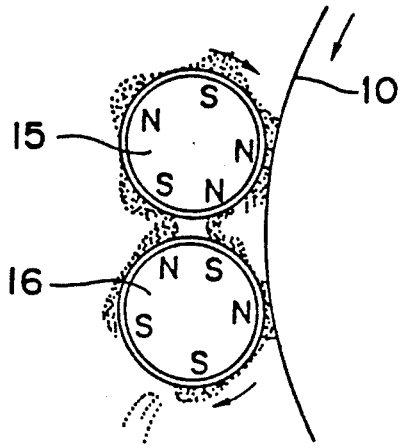

Moreover, according to a fourth embodiment of the present invention, as shown in FIG. 22, there are serially provided two developing rollers 15 and 16 in the developing device, wherein the developing roller 15 is the same as the developing roller 1 and the developing roller 16 is of a single pole type. These developing rollers 15 and 16 are simultaneously driven so that a toner image with weak edge effect is formed by the first developing roller 15, and a toner image with sharp edge effect is formed by the second developing roller 16. In this embodiment, a solid image and a line image can be reproduced while maintaining the characteristics thereof.

Figure 23:
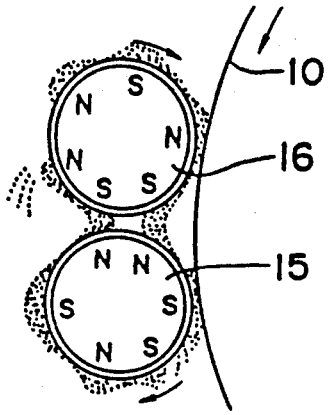

Moreover, as shown in FIG. 23, according to a fifth embodiment, the developing rollers 15 and 16 may be reversely arranged, that is to say, the developing roller 16 is positioned in the upper side in a rotating direction of the photosensitive member 10 and the developing roller 15 is positioned adjacently below the developing roller 16.

Figure 24:
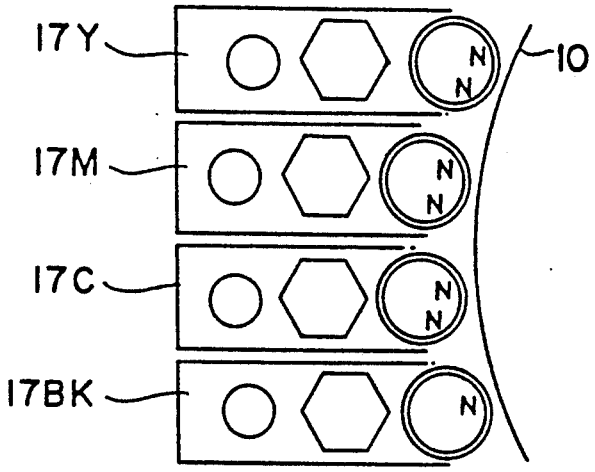
FIGS. 24 to 26 are partial sectional views each showing an essential part of an image forming device.

According to a sixth embodiment of the present invention, as shown in FIG. 24, there are provided four developing devices 17Y, 17M, 17C and 17BK respectively containing yellow, magenta, cyan and black toners along the moving direction of the photosensitive member 10. The developing devices 17Y, 17M and 17C have the construction same as that of the developing roller 1 used in the first embodiment, while the developing device 14BK has the construction same as that of the conventional developing roller 101*a*. In this preferred embodiment, a color image formed by the first through third developing devices 17Y, 17M and 17C is weak in edge effect. Therefore, even when the images of the three colors, namely, yellow, magenta and cyan are overlapped, the overlapped image including the edge can be reproduced with a uniform color tone. It is to be noted here that the edge effect is made sharp to work only on the black image formed by the fourth developing device 17BK. This is because the black image is often a line image in general. If necessary, however, the fourth developing device 17BK also may employ the construction same as that of the developing roller 1 used in the first embodiment similarly to the first through third developing devices 17Y, 17M and 17C.

Figure 25:
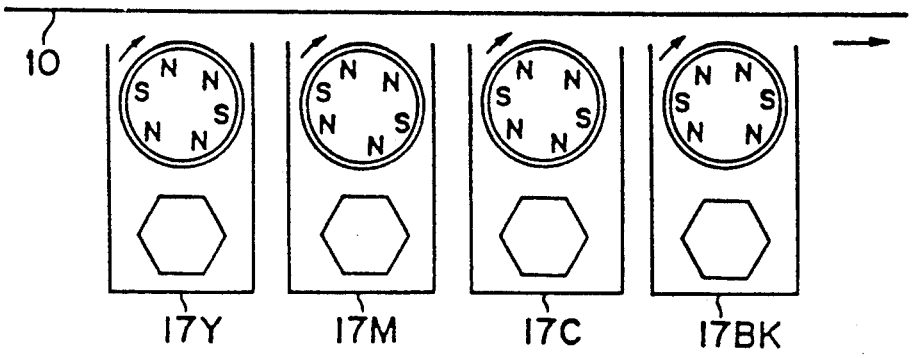

According to a seventh embodiment of the present invention, as shown in FIG. 25, a double magnetic poles N and N of the same polarity are arranged adjacent to each other in the developing device 17BK containing black toners in such a manner that the two magnetic poles N confront to the photosensitive member 10 so that the developer held by the two magnetic poles N are brought into contact with the photosensitive member 10. In this embodiment, since the developers just when the developers are separated from the photosensitive member 10 is in a high density, the edge effect is sharp in the black image obtained by the developing device. Moreover, although it is not shown in the drawing, since the scraping force of the developer against the toners adhered on the photosensitive member 10 is weak, it may be possible to overlap the toner images sequentially on the photosensitive member 10 rather than such a developing manner that the electrostatic latent image on the photosensitive member 10 is once transferred to an intermediate transfer member or recording paper prior to developing the next color image.

Figure 26:
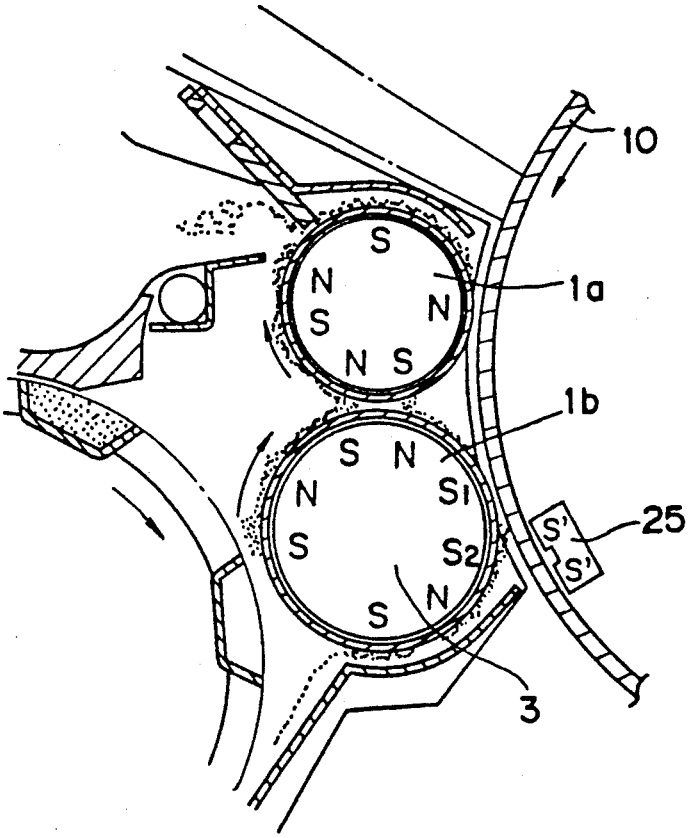

An image forming apparatus may be further modified as shown in FIG. 26, wherein a plurality of developing rollers 1*a* and 1*b* are provided at the lateral side of the photosensitive member 10. The developing roller 1*b* similar to the developing roller 1 is provided at the downstream side in the moving direction of the photosensitive member 10. The developing roller 1*b* is constructed in such a manner that, the magnetic poles $S_1$ and $S_2$ of the same polarity are so placed adjacent to each other as to confront to the photosensitive member 10. A magnet member 25 may be provided inside the photosensitive member 10, and the polarities of the magnetic poles $S_1'$ and $S_2'$ are the same as those of the magnetic poles $S_1$ and $S_2$, wherein the magnetic poles $S_1$ and $S_2$ confront to the magnetic poles $S_1'$ and $S_2'$. Since the developing roller 1*a* provided at the upstream side is of a single pole fixed type, the toner image formed by the developing roller 1*a* has sharp edge effect. On the contrary, the toner image formed by the developing roller 1*b* is weak in edge effect. Therefore, according to the image forming apparatus of this embodiment, a solid image and a line image can be reproduced with their characteristics made alive.

Figure 27:
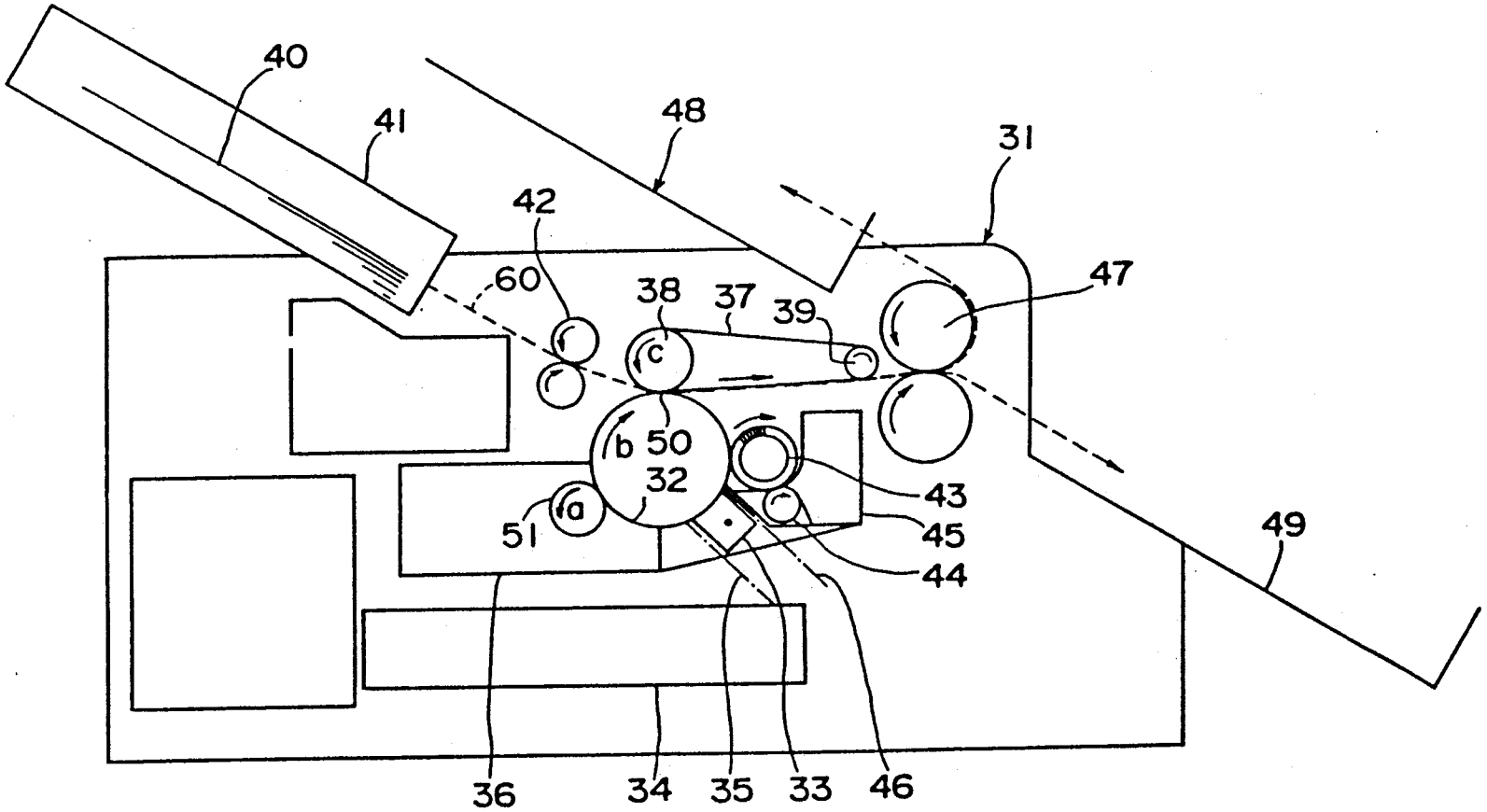
FIG. 27 is a cross sectional view of a printer.

FIG. 27 shows a printer of a roller transfer type employing a preferred embodiment of a developing device according to the present invention.

In a printer 31, a photosensitive member 32 is rotated in a direction shown by an arrow b and a photosensitive layer on the outer periphery thereof is charged with 600 to 800 volts by a charger 33. An optical laser head 34 emits laser beams in accordance with image information and when the laser beams are radiated to a charging zone of the photosensitive layer of the photosensitive member 32, an electrostatic latent image is formed on the photosensitive layer. A developing device 36 includes a developing roller 51 and contains developers of two components consisting of toners and carriers. A toner image is formed by feeding the charged toners to the part of the electrostatic latent image formed on the photosensitive layer.

A transfer belt 37 made of an electrically insulative material is wound around a transfer roller 38 and a driven roller 39. The transfer roller 38 is obtained in such a manner that an electrically conductive foam is fitted on the outer surface of a core metal so that the outer surface of the foam is coated with an electrically conductive film. The electric resistance of the transfer roller 38 is set to $10^5 \sim 10^{10}$ Ω.cm. Moreover, the transfer roller 38 is supplied with a voltage of 800~1,500 volts and is pressed against the photosensitive member 32 via the transfer belt 37 by a spring (not shown).

When the transfer roller 38 is driven, the transfer belt 37 is rotated in a direction shown by an arrow c opposite to the rotating direction b of the photosensitive member 32. In the contacting portion between the photosensitive member 32 and the transfer belt 37, both contacting parts of the photosensitive member 32 and the transfer belt 37 are moved in the same direction (to the right in the drawing). Transfer sheets 40 are accommodated in a cartridge 41 and fed one by one along a chain line 60 so as to be guided to a pressed portion 50 (referred to as a nip part hereinafter) between the photosensitive member 32 and the transfer roller 38 through a timing roller 42 in synchronization with the toner image. At this nip part 50, the toner image formed on the photosensitive member 32 is transferred to the transfer sheet 40 by pressing. In this transfer operation, since the photosensitive member 32 and the transfer belt 37 are moved in the same direction at the same speed at the nip part 50, the toner image is transferred to the transfer sheet 40 without occurrence of a transfer shift of the image.

The remaining toners on the photosensitive member 32 which are not transferred to the transfer sheet 40 are scraped off by a fur brush 43 rotating in contact with the photosensitive member 32. The toners scraped by the fur brush 43 are caught by a collecting roller 44 and collected in a container 45. Moreover, the residual charges on the photosensitive member 32 are erased by an eraser beam 46 projected from an eraser (not shown) in preparation for a next image formation.

On the other hand, the transfer sheet 40 having the toner image transferred thereon is carried to a fixing device 47 while being retained by the electric suction force of the transfer belt 37. In the fixing device 47, the transferred toner image is melted and fixed on the transfer sheet 40, and thereafter the transfer sheet 40 with the toner image fixed thereon is discharged to either a face up tray 48 or a face down tray 49.

Figure 28:
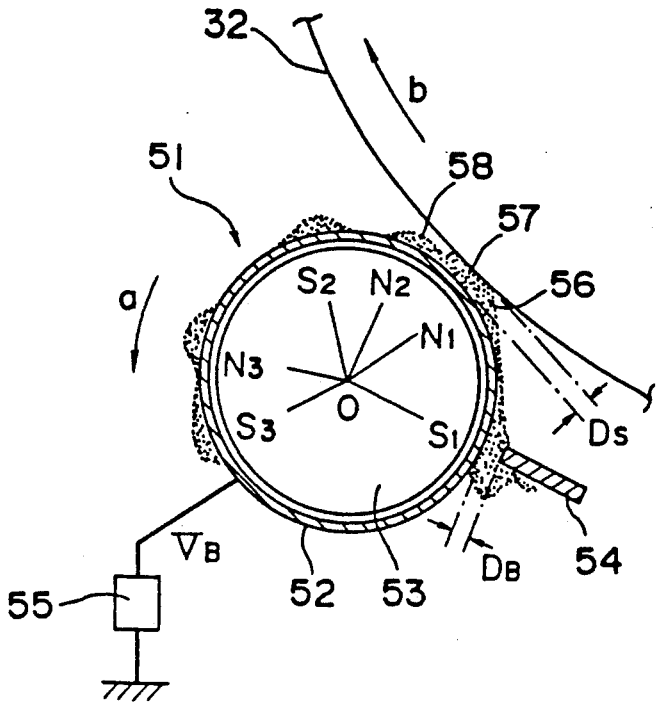
FIG. 28 is a partial sectional view of a printer.

Next, the construction of the developing unit of the developing device 36 is described with reference to FIG. 28. There is provided a developing roller 51 in the developing unit of the developing device 36. The developing roller 51 is constructed of a cylindrical sleeve 52 rotatably driven and a magnet member 53 non-rotatably fixed inside the sleeve 52, and a regulator plate 54 is provided in a position confronting to a part of the outer surface of the sleeve 52 with a narrow space $D_B$ (referred to as a regulator gap hereinafter).

The sleeve 52 is supplied with a bias voltage $V_B$ by a power source 55 and the value of the bias voltage $V_B$ is set in a range of 100 to 150 volts when a normal (non-inversed) development is performed and set in a range of 550 to 750 volts when an inversed development is performed. The space $D_s$ (referred to as a developing gap hereinafter) between the sleeve 52 and the photosensitive member 32 is set to 0.7 mm, and the regulator gap $D_B$ between the sleeve 52 and the regulator plate 54 is set to 0.5 mm.

The magnet member 53 is provided with a plurality of pairs of magnetic poles N and S alternately arranged in the order of first to sixth magnetic poles $S_1$, $N_1$, $N_2$, $S_2$, $N_3$ and $S_3$ in the rotating direction of the sleeve 52 in the outer periphery of the magnet member 53, each pole extending in an axial direction of the sleeve 52. More specifically, a double pairs of magnetic poles ($N_1$, $S_1$) and ($N_2$, $S_2$) are respectively arranged in the upstream side and downstream side in the rotating direction of the sleeve 52 in such a manner that a second magnetic pole $N_1$ and a third magnetic pole $N_2$ of the same polarities adjacently face to each other with a space of a rotating angle of 30° therebetween, wherein the second and third magnetic poles $N_1$ and $N_2$ confront to the photosensitive member 52 and the first magnetic pole $S_1$ confronts to the end of the regulator plate 54. Moreover, the intensity of the magnetic poles $N_1$ and $N_2$ on the outer surface of the sleeve 52 is set in a range of 800~1,200 gauss, and the fall of the magnetic force between the two magnetic poles $N_1$ and $N_2$ is set to be approximately 60 to 90 percentage of the larger one of the two magnetic poles $N_1$ and $N_2$.

In this construction of the developing device mentioned above, the toners and carriers are mixed in a stirring device (not shown), and the toners and carriers are respectively charged with different polarities opposite to each other and fed to the developing roller 51. As the carriers, any one of carriers such as a binder carrier, ferrite carrier, iron filing carrier or those carriers having overcoated thereon may be used.

The developers supplied to the developing roller 51 are sucked by the first magnetic pole $S_1$ in the outer periphery of the magnet member 53 and retained on the outer surface of the sleeve 52. The developers retained on the sleeve 52 are transported in the direction shown by an arrow a with the rotation of the sleeve 52, wherein the amount of the developers to be transported is regulated by the regulator plate 54. The developers are passed through the regulator gap $D_B$ toward an upper developing zone corresponding to the second magnetic pole $N_1$.

Since the second and third magnetic poles $N_1$ and $N_2$ have the same polarity, the lines of magnetic force generated by the second magnetic pole $N_1$ are concentrated to the first magnetic pole $S_1$ and similarly the lines of magnetic force generated by the third magnetic pole $N_2$ are concentrated to the fourth magnetic pole $S_2$. Accordingly, the developers transported to the upper developing zone corresponding to the second magnetic pole $N_1$ are restricted by the magnetic field generated by the second magnetic pole $N_1$ toward the first $S_1$ and by the repulsive magnetic field generated between the two magnetic poles $N_1$ and $N_2$, thereby forming a mass of developers 56 in the upper developing zone.

The mass of developers in the upper developing zone 56 corresponding to the second magnetic pole $N_1$ is pushed ahead by the subsequent developers fed from the upstream side so as to be transported toward the lower developing zone 58 corresponding to the third magnetic pole $N_2$ through the middle developing zone 57 while being retained by the sleeve 52 in a state of a magnetic brush without leaping of a developer. Subsequently, the developers in the lower developing zone 58 retained by the third magnetic pole $N_2$ are transported in a direction shown by the arrow a with the rotation of the sleeve 52 toward the sixth magnetic pole $S_3$ via the fourth and fifth magnetic poles $S_2$ and $N_3$. Thereafter, the developers are transported to a releasing zone (i.e., lower part of the sleeve 52 in the drawing) between the sixth and first magnetic poles $S_3$ and $S_1$, where the developers are released from the magnetic restricting force of the magnet member 53 so as to be dropped from the sleeve 52.

On the other hand, the mass of developers in the upper developing zone 56 retained by the second magnetic pole $N_1$ and the developers in the middle developing zone 57 corresponding to the intermediate portion between the second and third magnetic poles $N_1$ and $N_2$ are brought into contact with a part of the photosensitive member 32 corresponding to an electrostatic latent image formed thereon, whereby the electrostatic latent image is developed to be visualized. As described above, the developers in the upper developing zone 56 retained by the second magnetic pole $N_1$ are in high density, the developers in the middle developing zone 57 retained by the intermediate portion between the two magnetic poles $N_1$ and $N_2$ are in low density, and the developers in the lower developing zone 58 retained by the third magnetic pole $N_2$ are in middle density.

Accordingly, the developed toner image is weak in edge effect with flatness. Therefore, the toners on the photosensitive member 32 can be almost completely transferred to the transfer sheet 40 at the nip part 50, so that the very little amount of toners remains on the photosensitive member 32 after the transfer operation. Needless to say, according to this embodiment, an image of high quality can be obtained, avoiding occurrence of a toner fog, scratch patterns in the leading or trailing part of the image, a white portion due to blank printing in the leading part, white lines due to foreign substances clogged in the regulator gap, and adhesion of carriers losing their toners for development to the photosensitive member.

Although the developers of two components are used in the embodiment as mentioned above, only the developers of a single component composed of magnetic toners may be used. In this case, the magnetic force of each of the magnetic poles $N_1$ and $N_2$ is set in a range of 700 to 1,300 gauss on the outer periphery surface of the sleeve. Moreover, the developing gap $D_s$ and regulating gap $D_B$ are respectively set to 0.25~0.3 mm and 0.15~0.2 mm.

Figure 29:
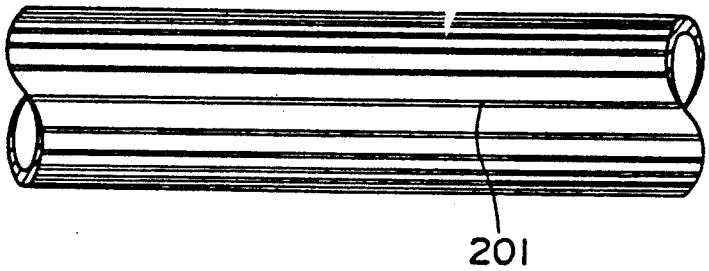
FIG. 29 is a partial front view of a sleeve.

Referring to FIG. 29, in the outer surface of the sleeve used in the developing device according to the present invention, it is desirable that grooves 201 of 5 to 500 μm deep are formed in the axial direction of the sleeve at intervals with the same spaces, alternately, the surface is made uneven with minute ruggedness to the same degree by a blast process or the like. This is because, if the outer surface of the sleeve is made even like a mirror face, the developers retained by the magnetic pole $N_1$ in the upstream side are easily slipped, therefore there often occurs a problem that the developers can not be transported to the intermediate portion between the two magnetic poles $N_1$ and $N_2$, and moreover, it is very difficult to set the magnetic force in a condition that there occurs no leaping of a developer. On the contrary, when the outer surface of the sleeve is made uneven or rugged, the friction of the sleeve against the developers becomes large, so that the action of transporting the developers is improved, thereby facilitating to transport the developers to the intermediate portion of the two magnetic poles $N_1$ and $N_2$ and facilitating to set the magnetic force.

Moreover, it is desirable that the bias voltage $V_B$ to be applied to the sleeve is obtained by piling A.C. voltage upon D.C. voltage. This is because, by piling the A.C. voltage upon the D.C. voltage a vibration is applied to the developers so that the supply of the toners to the photosensitive member can be improved and a sufficient density of an image can be easily obtained. In this case, however, in the A.C. voltage, it is desirable that the frequency thereof is in a range of 0.5 KHz to 5 KHz and that the voltage (peak-to-peak voltage)/developing gap (space between the photosensitive member and the sleeve) is set in a range of 1 to 10 KV/mm. This is because, when the frequency thereof is below 0.5 KHz, there occurs a striped pattern in the image, and when beyond 5 KHz, the effect of improvement of the density of the image can not be obtained. Moreover, when the value of (voltage)/(developing gap) is smaller than 1 KV/mm, the effect of improving the density can not be obtained, and when beyond 10 KV/mm, there occurs a leak between the photosensitive member and the sleeve.

As described above, in a double pole type developing device of the same polarity according to the present invention and an image forming apparatus accommodating the same, the developers in low density are retained also in the middle developing zone corresponding to the intermediate portion between the two magnetic poles of the same polarity, wherein the development of an electrostatic latent image is completed by contacting the developers of low density retained in the middle developing zone with the photosensitive member.

Accordingly, there can be obtained a toner image with weak edge effect preventing a lot of toners from being adhered to the edge of the electrostatic latent image. Therefore, even when an image of dots is developed, the individual dots can be clearly reproduced. Moreover, even when an image is formed by overlapping a plurality of color images, there can be obtained an image with uniform density as a whole.

Moreover, in the upper developing zone corresponding to the magnetic pole in the upstream side, the lines of magnetic force generated by the magnetic pole $N_1$ are extended toward the magnetic pole $S_1$ positioned in the further upper side thereof, therefore the end portion of the magnetic brush is laid down along the direction of the magnetic field so that the developers at the end of the magnetic brush are affected by a force directed towards the magnetic pole $S_1$ from the magnetic pole $N_1$ which is inverse to the transporting direction of the developer. Therefore, the effect of toner scratch is reduced compared to that of the magnetic brush which stands straight in the conventional developing device. Therefore, the scratch patterns in the leading part or trailing part of the image can be reduced and an image with its clear feature can be obtained suppressing the generation of a white portion in the leading part of the image.

Moreover, since the developers of the magnetic brush retained by the magnetic pole $N_1$ are stirred in a three-dimensional direction, even if a foreign substance clogs between the regulator plate and the sleeve, the developers can be supplied to a part where the developer is removed by the foreign substance. Accordingly, the obtained image has no part with the image lost, i.e., has no white lines.

Furthermore, since the developers are in a state of low density just when the developers are separated from the photosensitive member, therefore the carriers having their toners lost are little caught by the snake (or runaround) electric field around the edge of the electrostatic latent image, thereby suppressing the adhesion of the carriers to the photosensitive member.

That is to say, the developing device according to the present invention has various advantages compared to the conventional device as following:

(A) an image of uniform density can be obtained without excessive edge effect;

(B) an image can be obtained without a scratch pattern in the leading or trailing part of the image;

(C) a white line due to absence of a developer can be prevented from being caused by foreign substance in an image; and (D) the problems of a toner fog and carrier adhesion can be avoided.

In addition, according to the developing device having a second magnet member provided inside the photosensitive member, the developers retained by the magnetic pole at the downstream side can be surely prevented from contact with the photosensitive member and from leaping and dropping.

Furthermore, according to the image forming apparatus of a roller transfer type accommodating the developing device of the present invention, the developed toner image is weak in edge effect with flatness. Therefore, the toners on the photosensitive member 32 can be almost completely transferred to the transfer sheet 40 at the nip part 50, so that the very little amount of toners remains on the photosensitive member 32 after the transfer operation. Also, an image of high quality can be obtained, avoiding occurrence of a toner fog, scratch patterns in the leading or trailing part of the image, a white portion due to blank printing in the leading part, white lines due to foreign substances clogged in the regulator gap, and adhesion of carriers to the photosensitive member.

Although the developer is a two component developer composed of toners and carriers in the first embodiment, a single component developer composed of one kind of magnetic particles may be used in the image forming apparatus of the present invention.

Although the present invention has been fully described with reference to the accompanying drawings, it is to be noted here that various changes and modifications will be apparent to those skilled in the art without departing from the spirit and scope of the invention as defined by the appended claims.

What is claimed is:

1. A developing device for developing an electrostatic latent image formed on a rotating photosensitive member by bringing developer into contact with said photosensitive member, comprising:

a magnet member which is nonrotatably fixed in a sleeve, and said sleeve being rotated around said magnet member and retaining the developer on its outer periphery;

said magnet member being provided with four sequential magnetic poles, said four poles including an upstream magnetic pole arranged upstream of a magnet portion confronting said photosensitive member, first and second magnetic poles of an identical polarity, said first magnetic pole being disposed adjacent to and upstream of said second magnetic pole in a rotational direction of said sleeve, said first and second magnetic poles provided at the portion confronting said photosensitive member, and a downstream magnetic pole arranged downstream of the confronting portion, said upstream and downstream magnetic poles having a polarity opposite to the polarity of the first and second magnetic poles;

the developer being successively retained between said first and second magnetic poles and on an outer peripheral surface of said sleeve so as to include an upstream part retained by said first magnetic pole, an intermediate part retained by an intermediate portion between said first and second magnetic poles and a downstream part retained by said second magnetic pole;

wherein the upstream part and the intermediate part of the developer are brought into contact with said photosensitive member, while the downstream of the developer is held out of contact with said photosensitive member; and wherein a spacing between the second magnetic pole and the downstream magnetic pole is such that the downstream part of the developer is magnetically drawn to the downstream magnetic pole, and the four poles are arranged such that the development of the electrostatic latent image is completed by the intermediate portion of the developer which is between the first and second magnetic poles.

2. The developing device as claimed in claim 1, wherein a bias voltage obtained by adding an A.C. voltage to a D.C. voltage is applied to said sleeve.

3. The developing device as claimed in claim 1, wherein assuming that, between said first and second magnetic poles of said magnet member, magnetic force assumes a maximum value Mu and a minimum value Md, the value of Md/Mu ranges from 0.6 to 0.9.

4. The developing device as claimed in claim 1, wherein a peripheral speed of said sleeve is higher than that of said photosensitive member.

5. The developing device as claimed in claim 1, wherein the downstream part of the developer is deflected toward the downstream magnetic pole.

6. A developing device for developing an electrostatic latent image formed on a rotating photosensitive member by bringing developer into contact with said photosensitive member, comprising:

a magnet member which is nonrotatably fixed in a sleeve, and said sleeve being rotated around said magnet member and retaining the developer on its outer periphery;

said magnet member being provided with four sequential magnetic poles, said four poles including an upstream magnetic pole arranged upstream of a magnet portion confronting said photosensitive member, first and second magnetic poles of an identical polarity, said first magnetic pole being disposed adjacent to an upstream of said second magnetic pole in a rotational direction of said sleeve, said first and second magnetic poles provided at the portion confronting said photosensitive member, and a downstream magnetic pole arranged downstream of the confronting portion, said upstream and downstream magnetic poles having a polarity opposite to the polarity of the first and second magnetic poles;

the developer being successively retained between said first and second magnetic poles and on an outer peripheral surface of said sleeve so as to include an upstream part retained by said first magnetic pole, an intermediate part retained by an intermediate portion between said first and second magnetic poles and a downstream part retained by said second magnetic pole;

wherein the upstream part and the intermediate part of the developer are brought into contact with said photosensitive member, while the downstream part of the developer is held out of contact with said photosensitive member; and wherein a spacing between the second magnetic pole and the downstream magnetic pole is such that the downstream part of the developer is magnetically drawn to the downstream magnetic pole, and the four poles are arranged such that the developer directly between the second magnetic pole and the photosensitive member is drawn toward the downstream magnetic pole and does not contact the photosensitive member.

7. The developing device as claimed in claim 6, wherein the downstream part of the developer is deflected toward the downstream magnetic pole.

8. The developing device as claimed in claim 6, wherein a bias voltage obtained by adding an A.C. voltage to a D.C. voltage is applied to said sleeve.

9. The developing device as claimed in claim 6, wherein assuming that, between said first and second magnetic poles of said magnet member, magnetic force assumes a maximum value Mu and a minimum value Md, the value of Md/Mu ranges from 0.6 to 0.9.

10. The developing device as claimed in claim 6, wherein a peripheral speed of said sleeve is higher than that of said photosensitive member.

11. An image forming apparatus including a developing device for developing an electrostatic latent image formed on a rotating photosensitive member by bringing developer into contact with said photosensitive member, said developing device comprising:

a magnetic member which is nonrotatably fixed in a sleeve, said sleeve being rotated around said magnet member and retaining the developer on its outer periphery;

said magnet member being provided with four sequential magnetic poles, said four poles including an upstream magnetic pole arranged upstream of a magnet portion confronting said photosensitive member, first and second magnetic poles of an identical polarity, said first magnetic pole being disposed adjacent to and upstream of said second magnetic pole in a rotational direction of said sleeve, said first and second magnetic poles provided at the portion confronting said photosensitive member, and a downstream magnetic pole arranged downstream of the confronting portion, said upstream and downstream magnetic poles having a polarity opposite to the polarity of the first and second magnetic poles;

the developer being successively retained between said first and second magnetic poles and on an outer peripheral surface of said sleeve so as to include an upstream part retained by said first magnetic pole, an intermediate part retained by an intermediate portion between said first and second magnetic poles and a downstream part retained by said magnetic pole;

wherein the upstream part and the intermediate part of the developer are brought into contact with said photosensitive member, while the downstream part of the developer is held out of contact with said photosensitive member; and wherein a spacing between the second magnetic pole and the downstream magnetic pole is such that the downstream part of the developer is magnetically drawn to the downstream magnetic pole, and the four poles are arranged such that the development of the electrostatic latent image is completed by the intermediate portion of the developer which is between the first and second magnetic poles.

12. The image forming apparatus as claimed in claim 11, further comprising:

a second magnet member which is provided inside said photosensitive member, said second magnet member having a magnetic pole of the same polarities as those of the first and second magnetic poles such that said magnetic pole of said second magnet member confronts said first and second magnetic poles.

13. The image forming apparatus as claimed in claim 11, further comprising:

a transfer roller which is pressed against said photosensitive member such that a nip portion is defined between said photosensitive member and said transfer roller;

wherein a transfer sheet is carried into the nip portion such that a toner image formed on said photosensitive member is transferred onto the transfer sheet.

14. The developing device as claimed in claim 11, wherein the downstream part of the developer is deflected toward the downstream magnetic pole.

15. An image forming apparatus including a developing device for developing an electrostatic latent image formed on a rotating photosensitive member by bringing developer into contact with said photosensitive member, said developing device comprising:

a magnetic member which is nonrotatably fixed in a sleeve, said sleeve being rotated around said magnet member and retaining the developer on its outer periphery;

said magnet member being provided with four sequential magnetic poles, said four poles including an upstream magnetic pole arranged upstream of a magnet portion confronting said photosensitive member, first and second magnetic poles of an identical polarity, said first magnetic pole being disposed adjacent to and upstream of said second magnetic pole in a rotational direction of said sleeve, said first and second magnetic poles provided at the portion confronting said photosensitive member, and a downstream magnetic pole arranged downstream of the confronting portion, said upstream and downstream magnetic poles having a polarity opposite to the polarity of the first and second magnetic poles;

the developer being successively retained between said first and second magnetic poles and on an outer peripheral surface of said sleeve so as to include an upstream part retained by said first magnetic pole, an intermediate part retained by an intermediate portion between said first and second magnetic poles and a downstream part retained by said magnetic pole;

wherein the upstream part and the intermediate part of the developer are brought into contact with said photosensitive member, while the downstream part of the developer is held out of contact with said photosensitive member; and wherein a spacing between the second magnetic pole and the downstream magnetic pole is such that the downstream part of the developer is magnetically drawn to the downstream magnetic pole, and the four poles are arranged such that the developer directly between the second magnetic pole and the photosensitive member is drawn toward the downstream magnetic pole and does not contact the photosensitive member.

16. The developing device as claimed in claim 15, wherein the downstream part of the developer is deflected toward the downstream magnetic pole.

17. The image forming apparatus as claimed in claim 15, further comprising:

a second magnet member which is provided inside said photosensitive member, said second magnet member having a magnetic pole of the same polarities as those of the first and second magnetic poles such that said magnetic pole of said second magnet member confronts said first and second magnetic poles.

18. The image forming apparatus as claimed in claim 15, further comprising:

a transfer roller which is pressed against said photosensitive member such that a nip portion is defined between said photosensitive member and said transfer roller;

wherein a transfer sheet is carried into the nip portion such that a toner image formed on said photosensitive member is transferred onto the transfer sheet.

* * * * *